US012479638B2

(12) United States Patent
Zhou et al.

(10) Patent No.: US 12,479,638 B2
(45) Date of Patent: Nov. 25, 2025

(54) CAP ASSEMBLY AND BOTTLE ASSEMBLY

(71) Applicant: Illinois Tool Works Inc., Glenview, IL (US)

(72) Inventors: Pan Zhou, Shanghai (CN); Guilin Kuang, Shanghai (CN); Hui Huang, Shanghai (CN)

(73) Assignee: Illinois Tool Works Inc., Glenview, IL (US)

( * ) Notice: Subject to any disclaimer, the term of this patent is extended or adjusted under 35 U.S.C. 154(b) by 172 days.

(21) Appl. No.: 18/227,778

(22) Filed: Jul. 28, 2023

(65) Prior Publication Data

US 2024/0051720 A1 Feb. 15, 2024

(30) Foreign Application Priority Data

Aug. 11, 2022 (CN) ..... 202210963718.5
Jul. 21, 2023 (CN) ..... 202310905713.1

(51) Int. Cl.
*B65D 23/00* (2006.01)
*B65D 55/12* (2006.01)
*F25B 45/00* (2006.01)

(52) U.S. Cl.
CPC ..... *B65D 55/12* (2013.01); *B65D 23/00* (2013.01); *B65D 2255/20* (2013.01)

(58) Field of Classification Search
CPC ..... B65D 1/02; B65D 1/0207; B65D 1/023; B65D 1/0246; B65D 1/0261; B65D 1/095;
(Continued)

(56) References Cited

U.S. PATENT DOCUMENTS 5,114,035 A * 5/1992 Brown ..... F01P 11/0238 220/203.26
11,199,348 B1 * 12/2021 Wang ..... B25B 27/24
(Continued)

FOREIGN PATENT DOCUMENTS

CA 975354 A * 9/1975 ..... F01P 11/0238
CA 1000268 A * 11/1976 ..... F01P 11/0238
(Continued)

*Primary Examiner* — Anthony D Stashick
*Assistant Examiner* — Marcos Javier Rodriguez Molina
(74) *Attorney, Agent, or Firm* — McAndrews, Held & Malloy, Ltd.

(57) ABSTRACT

The present application provides a cap assembly and a bottle assembly. The cap assembly is configured to lock a bottle. The bottle includes a bottle head having at least one lock accommodating portion and comprises a bottle body. The cap assembly includes a cap, an elastic arm and at least one lock portion. The cap defines an annular receiving portion having an opening facing downward, and the bottle head can enter the receiving portion through the opening. The elastic arm is annular and is arranged in the receiving portion. The at least one lock portion is arranged on the cap and is configured to be capable of cooperating with the at least one lock accommodating portion of the bottle head, so as to lock the cap assembly to the bottle head. When the cap assembly is locked to the bottle head, the elastic arm abuts against a top wall of the receiving portion and a top wall of the bottle head, to apply forces in opposite directions to the cap and the bottle head, so as to retain the at least one lock portion in the at least one lock accommodating portion. The cap assembly of the present application has a relatively small height, and during unlocking of the bottle assembly of the present application, gas in a bottle body cavity can be discharged from the bottle through an exhaust passage.

13 Claims, 10 Drawing Sheets

Fig. 6K

(58) Field of Classification Search
CPC . B65D 1/10; B65D 1/22; B65D 1/225; B65D 1/26; B65D 1/265; B65D 1/46; B65D 11/16; B65D 11/1866; B65D 15/00; B65D 15/14; B65D 15/22; B65D 17/28; B65D 17/4011; B65D 17/4012; B65D 19/0002; B65D 19/0026; B65D 19/06; B65D 19/14; B65D 19/18; B65D 19/20; B65D 19/36; B65D 19/38; B65D 19/44; B65D 21/0204; B65D 21/0224; B65D 21/0228; B65D 21/0233; B65D 21/062; B65D 21/066; B65D 21/086; B65D 2203/00; B65D 2203/02; B65D 2203/06; B65D 2203/10; B65D 2203/12; B65D 2205/00; B65D 2205/02; B65D 2207/00; B65D 2213/00; B65D 2213/02; B65D 2215/00; B65D 2215/04; B65D 2215/08; B65D 2231/004; B65D 2231/022; B65D 2231/025; B65D 2251/0015; B65D 2251/0018; B65D 2251/0021; B65D 2251/0025; B65D 2251/0028; B65D 2251/0031; B65D 2251/0056; B65D 2251/0081; B65D 2251/0087; B65D 2251/009; B65D 2251/0093; B65D 2251/1016; B65D 2251/105; B65D 2251/1066; B65D 2251/1091; B65D 2251/20; B65D 2255/20; B65D 23/00; B65D 23/001; B65D 23/003; B65D 23/102; B65D 23/104; B65D 2313/02; B65D 2313/04; B65D 2401/10; B65D 2401/15; B65D 2401/60; B65D 25/02; B65D 25/04; B65D 25/06; B65D 25/10; B65D 25/108; B65D 25/14; B65D 25/20; B65D 25/24; B65D 25/2876; B65D 25/42; B65D 25/465; B65D 25/48; B65D 25/52; B65D 2501/0081; B65D 2517/0049; B65D 2519/00019; B65D 2519/00029; B65D 2519/00034; B65D 2519/00054; B65D 2519/00064; B65D 2519/00069; B65D 2519/00089; B65D 2519/00139; B65D 2519/00159; B65D 2519/00194; B65D 2519/00273; B65D 2519/00278; B65D 2519/00288; B65D 2519/00318; B65D 2519/00323; B65D 2519/00333; B65D 2519/00343; B65D 2519/00363; B65D 2519/00373; B65D 2519/00432; B65D 2519/00437; B65D 2519/00497; B65D 2519/00562; B65D 2519/00572; B65D 2519/00597; B65D 2519/00621; B65D 2519/00641; B65D 2519/00666; B65D 2519/00711; B65D 2519/00726; B65D 2519/0081; B65D 2519/00815; B65D 2519/0087; B65D 2519/0091; B65D 2519/00985; B65D 2519/0099; B65D 2543/00009; B65D 2543/00027; B65D 2543/00046; B65D 2543/00092; B65D 2543/00148; B65D 2543/00194; B65D 2543/00203; B65D 2543/00296; B65D 2543/00398; B65D 2543/00407; B65D 2543/00416; B65D 2543/00435; B65D 2543/00462; B65D 2543/00472; B65D 2543/005; B65D 2543/00509; B65D 2543/00518; B65D 2543/00527; B65D 2543/00537; B65D 2543/00546; B65D 2543/00555; B65D 2543/00564; B65D 2543/00574; B65D 2543/0062; B65D 2543/00629; B65D 2543/00685; B65D 2543/00694; B65D 2543/00731; B65D 2543/0074; B65D 2543/00796; B65D 2543/00805; B65D 2543/00842; B65D 2543/00898; B65D 2543/00972; B65D 2543/0099; B65D 2547/06; B65D 2547/066; B65D 2563/105; B65D 2563/106; B65D 2563/107; B65D 2565/386; B65D 2565/387; B65D 2571/00012; B65D 2571/00018; B65D 2571/0003; B65D 2571/00037; B65D 2571/00043; B65D 2571/00055; B65D 2571/00067; B65D 2571/0008; B65D 2571/00104; B65D 2571/00111; B65D 2571/00117; B65D 2571/00141; B65D 2571/00148; B65D 2571/000154; B65D 2571/00228; B65D 2571/00277; B65D 2571/00283; B65D 2571/0029; B65D 2571/00339; B65D 2571/00351; B65D 2571/0037; B65D 2571/00401; B65D 2571/00432; B65D 2571/00438; B65D 2571/00444; B65D 2571/0045; B65D 2571/00475; B65D 2571/00487; B65D 2571/00493; B65D 2571/00543; B65D 2571/00555; B65D 2571/00561; B65D 2571/00567; B65D 2571/0066; B65D 2571/00666; B65D 2571/00672; B65D 2571/00716; B65D 2571/00728; B65D 2571/00734; B65D 2571/00765; B65D 2571/0079; B65D 2571/00796; B65D 2571/00802; B65D 2571/0082; B65D 2571/00845; B65D 2575/3218; B65D 2575/3245; B65D 2575/363; B65D 2575/365; B65D 2575/58; B65D 2575/583; B65D 2575/586; B65D 2577/2025; B65D 2577/2033; B65D 2577/205; B65D 2581/053; B65D 2581/055; B65D 2581/3487; B65D 2581/3494; B65D 2585/649; B65D 2585/6815; B65D 2585/6817; B65D 2585/682; B65D 2585/6825; B65D 2585/6855; B65D 2585/6857; B65D 2585/6867; B65D 2590/005; B65D 2590/046; B65D 27/30; B65D 3/28; B65D 31/00; B65D 31/02; B65D 31/04; B65D 31/08; B65D 31/10; B65D 31/12; B65D 31/14; B65D 33/004; B65D 33/007; B65D 33/01; B65D 33/02; B65D 33/04; B65D 33/06; B65D 33/14; B65D 33/16; B65D 33/1666; B65D 33/1675; B65D 33/1691; B65D 33/18; B65D 33/20; B65D 33/22; B65D 33/24; B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2584; B65D 33/2586; B65D 33/25865; B65D 33/2588; B65D 33/2589; B65D 33/259; B65D 33/34; B65D 35/24; B65D 39/00; B65D 39/0052; B65D 39/02; B65D 39/025; B65D 39/04; B65D 39/084; B65D 39/16; B65D 41/023; B65D 41/04; B65D 41/0407; B65D 41/0414; B65D 41/045;

B65D 41/0471; B65D 41/0485; B65D 41/06; B65D 41/08; B65D 41/22; B65D 41/3404; B65D 41/3409; B65D 41/3447; B65D 41/3495; B65D 41/47; B65D 41/48; B65D 43/00; B65D 43/02; B65D 43/0202; B65D 43/0204; B65D 43/0206; B65D 43/021; B65D 43/0212; B65D 43/0218; B65D 43/022; B65D 43/0225; B65D 43/0233; B65D 43/0277; B65D 43/0283; B65D 43/06; B65D 43/065; B65D 43/16; B65D 43/166; B65D 43/168; B65D 43/169; B65D 45/16; B65D 45/18; B65D 45/20; B65D 45/32; B65D 45/345; B65D 47/00; B65D 47/046; B65D 47/06; B65D 47/061; B65D 47/066; B65D 47/0814; B65D 47/0842; B65D 47/0885; B65D 47/10; B65D 47/148; B65D 47/18; B65D 47/20; B65D 47/2018; B65D 47/2025; B65D 47/2031; B65D 47/2068; B65D 47/24; B65D 47/241; B65D 47/242; B65D 47/243; B65D 47/244; B65D 47/245; B65D 47/247; B65D 47/249; B65D 47/265; B65D 47/32; B65D 47/36; B65D 47/38; B65D 49/12; B65D 5/0005; B65D 5/0227; B65D 5/061; B65D 5/064; B65D 5/08; B65D 5/12; B65D 5/18; B65D 5/20; B65D 5/32; B65D 5/321; B65D 5/322; B65D 5/324; B65D 5/3621; B65D 5/3628; B65D 5/4266; B65D 5/4279; B65D 5/443; B65D 5/46024; B65D 5/4608; B65D 5/48026; B65D 5/5021; B65D 5/5047; B65D 5/5088; B65D 5/5092; B65D 5/544; B65D 5/606; B65D 5/62; B65D 5/6629; B65D 5/6638; B65D 5/6697; B65D 5/68; B65D 5/703; B65D 5/72; B65D 5/746; B65D 5/748; B65D 5/749; B65D 50/00; B65D 50/041; B65D 50/046; B65D 50/067; B65D 51/002; B65D 51/1633; B65D 51/1644; B65D 51/1672; B65D 51/1683; B65D 51/1688; B65D 51/1694; B65D 51/18; B65D 51/20; B65D 51/22; B65D 51/222; B65D 51/224; B65D 51/226; B65D 51/228; B65D 51/245; B65D 51/248; B65D 51/26; B65D 51/2864; B65D 51/2892; B65D 51/32; B65D 53/00; B65D 53/02; B65D 53/04; B65D 55/02; B65D 55/022; B65D 55/026; B65D 55/066; B65D 55/12; B65D 59/04; B65D 61/00; B65D 63/02; B65D 63/06; B65D 63/08; B65D 63/10; B65D 63/1063; B65D 63/1081; B65D 63/14; B65D 63/16; B65D 65/20; B65D 65/22; B65D 65/38; B65D 65/40; B65D 65/42; B65D 65/46; B65D 65/466; B65D 69/00; B65D 71/00; B65D 71/0003; B65D 71/0014; B65D 71/0025; B65D 71/004; B65D 71/0055; B65D 71/0085; B65D 71/0088; B65D 71/0096; B65D 71/02; B65D 71/04; B65D 71/063; B65D 71/066; B65D 71/08; B65D 71/10; B65D 71/125; B65D 71/243; B65D 71/42; B65D 71/44; B65D 71/46; B65D 71/48; B65D 71/50; B65D 71/504; B65D 71/506; B65D 71/508; B65D 71/70; B65D 73/0078; B65D 73/0085; B65D 73/0092; B65D 73/02; B65D 75/00; B65D 75/002; B65D 75/004; B65D 75/006; B65D 75/008; B65D 75/02; B65D 75/20; B65D 75/28; B65D 75/32; B65D 75/326; B65D 75/366; B65D 75/42; B65D 75/44; B65D 75/46; B65D 75/56; B65D 75/566; B65D 75/58; B65D 75/5805; B65D 75/5811; B65D 75/5816; B65D 75/5822; B65D 75/5827; F25B 45/00

USPC ..... 215/201

See application file for complete search history.

(56) References Cited

U.S. PATENT DOCUMENTS

| | | | | |
|---|---|---|---|---|
| 2005/0061014 | A1* | 3/2005 | Cannan | B60H 1/00585 62/77 |
| 2010/0109260 | A1* | 5/2010 | Mellander | F16J 15/061 277/619 |
| 2017/0284716 | A1* | 10/2017 | Carrubba | F25B 45/00 |
| 2019/0072306 | A1* | 3/2019 | Quest | G01L 7/082 |

FOREIGN PATENT DOCUMENTS

| | | | | |
|---|---|---|---|---|
| CN | 104350311 | A * | 2/2015 | B65D 47/10 |
| CN | 111252370 | A * | 6/2020 | B65D 41/3409 |
| DE | 2156654 | A1 * | 9/1972 | B65D 41/065 |
| DE | 2252750 | A1 * | 5/1973 | F01P 11/0238 |
| DE | 2630972 | A1 * | 1/1978 | F01P 11/0247 |
| DE | 20108735 | U1 * | 10/2002 | F01P 11/0247 |

* cited by examiner

CAP ASSEMBLY AND BOTTLE ASSEMBLY

RELATED APPLICATIONS

The present application claims the benefit of Chinese Patent Application Nos. CN 2022109637185, filed Aug. 11, 2022, and CN 2023109057131, filed Jul. 21, 2023, the contents of which are hereby incorporated by reference.

FIELD

The present application relates to the field of cap assemblies. More specifically, the present application relates to a cap assembly of a bottle assembly.

BACKGROUND

Existing vehicles are provided with refrigeration systems. The refrigeration system comprises a bottle. The bottle defines a bottle head. A coolant may be introduced into the refrigeration system from the bottle head. The bottle head needs to cooperate with a cap assembly matched therewith, such that the cap assembly can lock the bottle head.

SUMMARY

Exemplary embodiments of the present application may solve at least some of the above problems. The present application provides a cap assembly configured to lock a bottle. The bottle comprises a bottle head having at least one lock accommodating portion and comprises a bottle body. The cap assembly comprises a cap, an elastic arm and at least one lock portion. The cap defines an annular receiving portion having an opening facing downward, and the bottle head can enter the receiving portion through the opening. The elastic arm is annular and is arranged in the receiving portion. The at least one lock portion is arranged on the cap and is configured to be capable of cooperating with the at least one lock accommodating portion of the bottle head, so as to lock the cap assembly to the bottle head. The elastic arm is configured such that when the cap assembly is locked to the bottle head, the elastic arm abuts against a top wall of the receiving portion and a top wall of the bottle head, to apply forces in opposite directions to the cap and the bottle head, so as to retain the at least one lock portion in the at least one lock accommodating portion.

According to the cap assembly described above, the elastic arm is configured such that when the cap assembly is locked to the bottle head, the elastic arm seals the cap from the bottle head.

According to the cap assembly described above, the cap assembly further comprises an elastic ring arranged in the receiving portion. The elastic arm has a connecting end and a free end. The connecting end is connected to the elastic ring. The elastic arm is configured such that during the process of the at least one lock portion entering into the at least one lock accommodating portion, the free end of the elastic arm abuts against the top wall of the bottle head and moves toward the top wall of the receiving portion.

According to the cap assembly described above, the cap assembly further comprises a cap top, an inner cylinder and a cap side portion. The inner cylinder is formed extending from the cap top. The cap side portion is formed by extending from the cap top, and is arranged around the inner cylinder to form the receiving portion. The elastic ring is sleeved on an outer side of the inner cylinder, so as to prevent the elastic ring from moving relative to the cap.

According to the cap assembly described above, the cap assembly further comprises a sealing ring sleeved on the outer side of the inner cylinder. The sealing ring is configured such that when the cap assembly is locked to the bottle head, the sealing ring abuts against the bottle body, so as to seal the inner cylinder from the bottle body.

According to the cap assembly described above, the sealing ring is configured such that when the cap assembly is locked to the bottle head, a circumferential side portion of the sealing ring abuts against the bottle body, so as to seal the inner cylinder from the bottle body.

According to the cap assembly described above, the sealing ring is configured such that when the cap assembly is locked to the bottle head, a bottom portion of the sealing ring abuts against the bottle body, so as to seal the inner cylinder from the bottle body.

According to the cap assembly described above, the elastic arm and the sealing ring are configured such that during the process of the cap assembly unlocking from the bottle head, the elastic arm abuts against the top wall of the receiving portion and the top wall of the bottle head, so as to seal the cap assembly from the bottle head, and the sealing ring is separated from the bottle body.

According to the cap assembly described above, the at least one lock portion is arranged on an inner surface of the cap side portion, and is formed by extending inwardly from the inner surface.

The present application also provides a bottle assembly, comprising the cap assembly described above and a bottle. The bottle comprises a bottle head which can be accommodated in the receiving portion. The bottle head is provided with at least one lock accommodating portion configured to cooperate with the at least one lock portion, so as to lock the cap assembly to the bottle head.

According to the bottle assembly described above, the bottle head is provided with at least one protrusion formed by extending outwardly from an outer side wall of the bottle head. A bottom of the at least one protrusion forms the at least one lock accommodating portion.

According to the bottle assembly described above, the bottle further comprises a bottle body defining a bottle body cavity. The bottle head defines a bottle head passage which is in communication with the bottle body cavity. The bottle head is provided with an exhaust passage configured to penetrate the bottle head such that the exhaust passage is in communication with the bottle head passage. The bottle assembly is configured such that during the process of the cap assembly unlocking from the bottle head, the elastic arm abuts against the top wall of the receiving portion and a top wall of the bottle head, so as to seal the cap assembly from the bottle head, and the bottle body cavity is in communication with the exhaust passage through the bottle head passage.

The cap assembly of the present application has a relatively small height, and during unlocking of the bottle assembly of the present application, gas in a bottle body cavity can be discharged from the bottle through an exhaust passage.

BRIEF DESCRIPTION OF THE DRAWINGS

The features and advantages of the present application can be better understood by reading the following detailed description with reference to accompanying drawings. In all the accompanying drawings, the same reference numeral represents the same component. In the accompanying drawings.

DETAILED DESCRIPTION

Figure 1A:
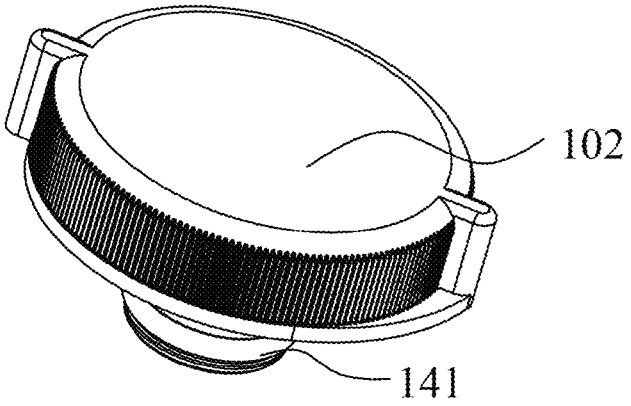
FIGS. 1A-1B are perspective views of a cap assembly according to a first embodiment of the present application.

Various specific implementations of the present application will be described below with reference to the accompanying drawings which form a part of this description. It should be understood that, in the following accompanying drawings, the same reference numeral is used for the same component.

Various specific implementations of the present application will be described below with reference to the accompanying drawings which form a part of this description. It should be understood that although the terms indicating directions, such as "upper", "lower", "left", "right", "inner", "outer", and so on are used in the present application to describe structural parts and elements in various examples of the present application, these terms are used herein only for ease of description and are determined based on the exemplary orientations as shown in the accompanying drawings. Since the embodiments disclosed in the present application can be arranged in different directions, these terms indicating directions are merely illustrative and should not be considered as limitations.

Figure 1B:
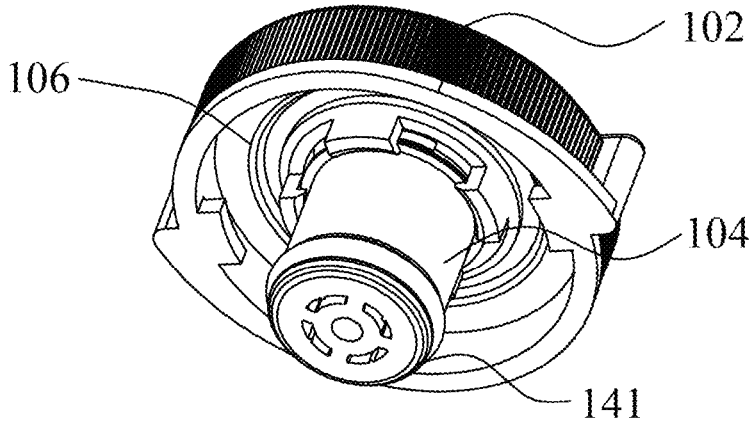
Figure 1C:
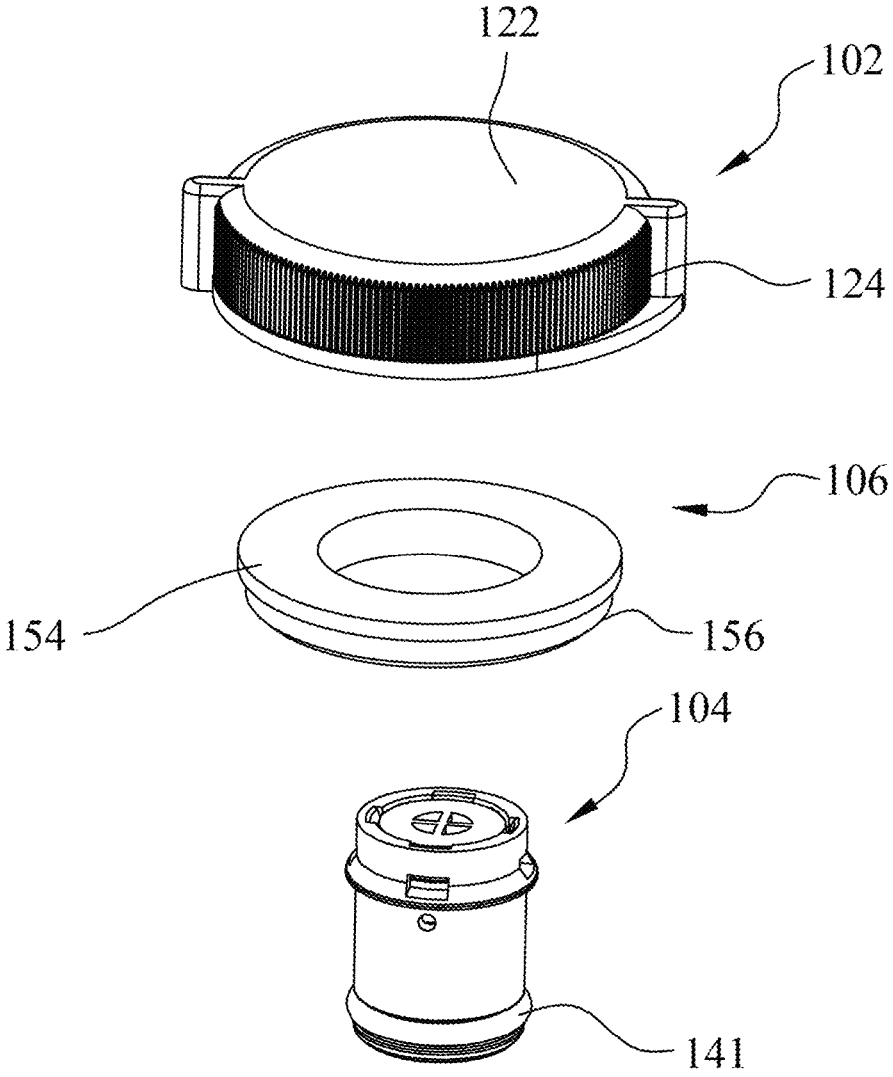
FIGS. 1C-1D are exploded views of the cap assembly shown in FIG. 1A.
Figure 1D:
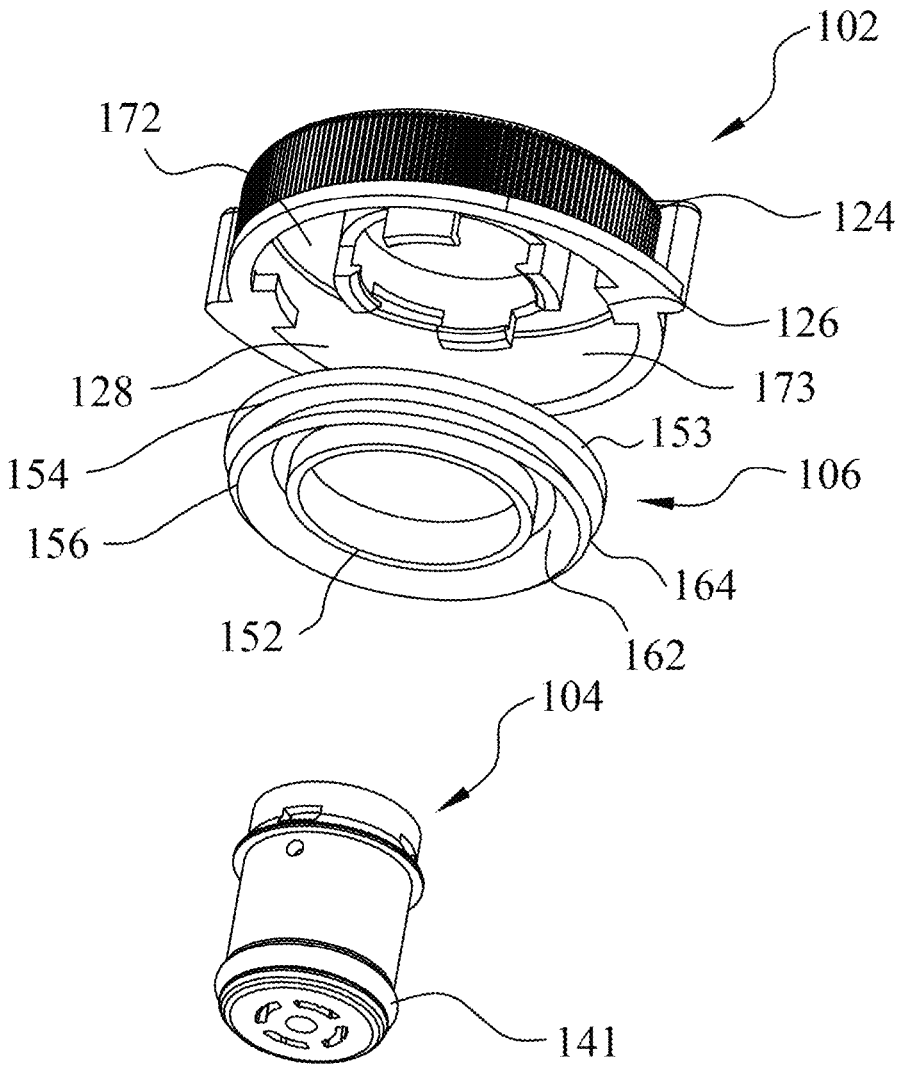
Figure 1E:
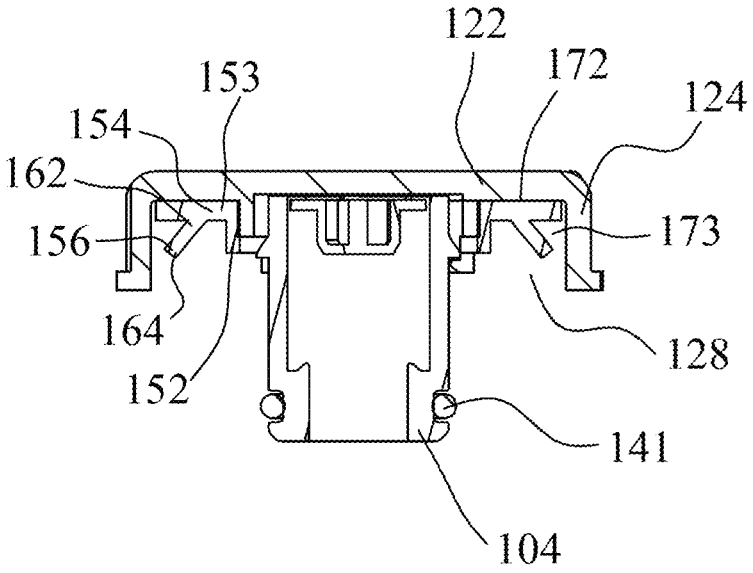
FIG. 1E is a cross-sectional view of the cap assembly shown in FIG. 1A.
Figure 2A:
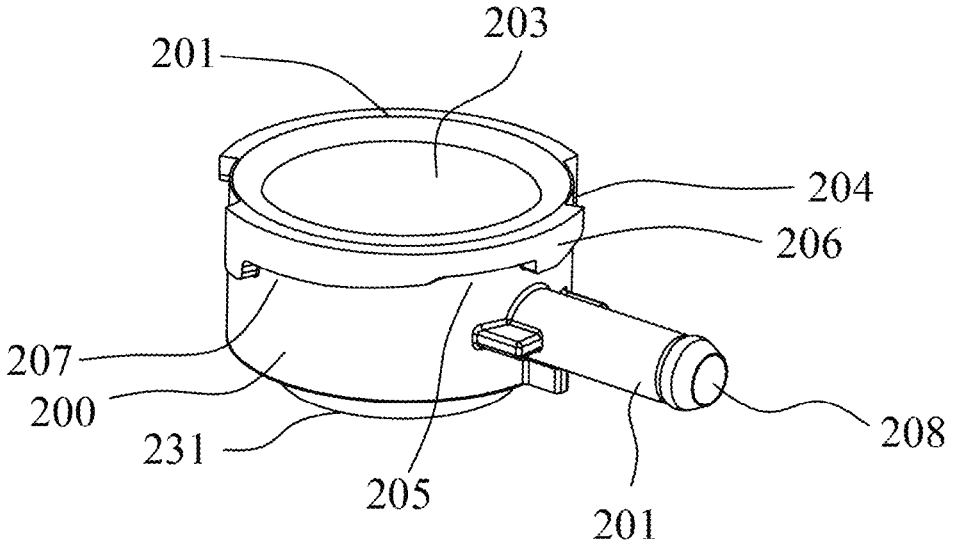
FIGS. 2A-2B are perspective views of a bottle cooperating with a cap assembly of the present application.
Figure 2B:
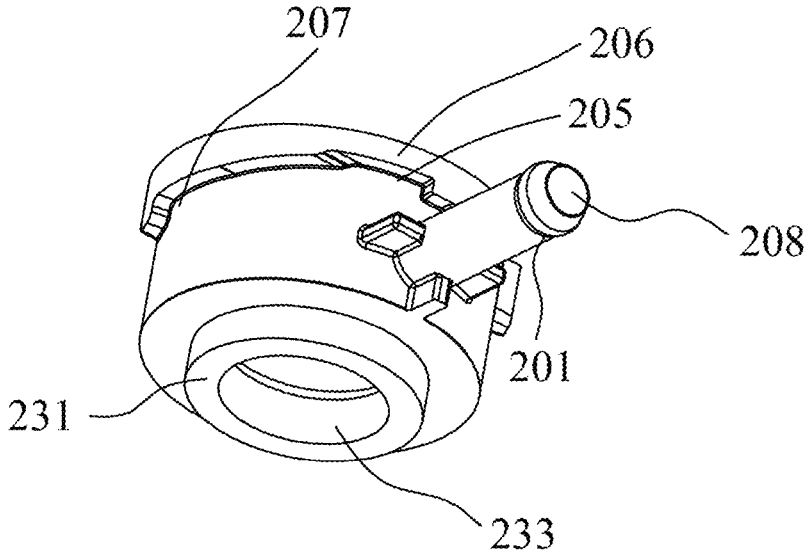

FIGS. 1A-1B are perspective views of a cap assembly according to a first embodiment of the present application. FIGS. 1C-1D are exploded views of the cap assembly shown in FIG. 1A. FIG. 1E is a cross-sectional view of the cap assembly shown in FIG. 1A. The cap assembly is configured to lock a bottle as shown in FIGS. 2A-2B. As shown in FIGS. 1A-1E, the cap assembly comprises a cap 102 and a sealing ring 141. The cap 102 comprises a cap top 122, a cap side portion 124 and an inner cylinder 104. Specifically, the cap top 122 is substantially disc-shaped. The inner cylinder 104 is formed by extending downwardly from a lower surface of the cap top 122. The cap side portion 124 is formed by extending downwardly from an outer side of the cap top 122 and is arranged around the inner cylinder 104 to form an annular receiving portion 173. The receiving portion 173 has an opening 128 facing downward, and has a top wall 172. A bottle head 200 (see FIG. 2A) of the bottle can enter the receiving portion 173 through the opening 128. The sealing ring 141 is sleeved on an outer side wall of the inner cylinder 104 and is substantially located at a lower portion of the inner cylinder 104 to abut against the bottle for sealing. The sealing ring 141 is configured such that when the cap assembly is locked to the bottle head 200, the sealing ring 141 abuts against the bottle head 200, so as to seal the inner cylinder 104 from the bottle head 200.

As shown in FIGS. 1B-1E, the cap assembly further comprises an elastic member 106 arranged in the receiving portion 173. Specifically, the elastic member 106 comprises an elastic ring 154 and an elastic arm 156. The elastic ring 154 and the elastic arm 156 are both annular, and are arranged in the receiving portion 173. The elastic ring 154 comprises a vertical portion 152 and a horizontal portion 153. The vertical portion 152 and the horizontal portion 153 are both annular. The vertical portion 152 is sleeved on the outer side of the inner cylinder 104 to prevent the elastic member 106 from moving relative to the cap 102. The horizontal portion 153 is formed by extending outwardly from a top portion of the vertical portion 152 in a radial direction of the cap 102, and is configured to abut against the lower surface of the cap top 122. The elastic arm 156 is arranged obliquely to the horizontal portion 153 and the vertical portion 152. Specifically, the elastic arm 156 has a connecting end 162 and a free end 164. The connecting end 162 is configured to be connected to the horizontal portion 153 of the elastic ring 154. The free end 164 of the elastic arm is configured to abut against the bottle head 200. The elastic arm 156 is configured such that when the cap assembly is locked to the bottle head 200, the free end 164 of the elastic arm 156 abuts against the bottle head 200, and the connecting end 162 of the elastic arm 156 abuts against the top wall 172 of the receiving portion 173 via the horizontal portion 153, so as to apply forces in opposite directions to the cap 102 and the bottle head 200. In addition, the elastic arm 156 is configured such that when the cap assembly is locked to the bottle head 200, the elastic arm 156 can seal the cap 102 from the bottle head 200. More specifically, the elastic member 106 is made of a flexible material. The elastic ring 154 may be configured such that an inner diameter of the elastic ring 154 is slightly smaller than an outer diameter of the inner cylinder 104, so that the elastic ring 154 can be sleeved on the outer side of the inner cylinder 104 and connected to the inner cylinder 104, and the elastic member 106 remains at a top portion of the receiving portion 173. Since the elastic member 106 is made of a flexible material, when the elastic arm 156 is subjected to an external force in a vertical direction, the elastic arm 156 can be deformed to move relative to the elastic ring 154. More specifically, the elastic arm 156 has an release state and a compressed state. When the elastic arm 156 is in the release state, the distance between the free end 164 of the elastic arm 156 and a lower surface of the horizontal portion 153 is a first distance L1 (referring to FIG. 3C). When the elastic arm 156 is in the compressed state, the distance between the free end 164 of the elastic arm 156 and the lower surface of the horizontal portion 153 is a second distance L2 (referring to FIG. 3B). The first distance L1 is greater than the second distance L2.

As shown in FIG. 1D, the cap side portion 124 is provided with two lock portions 126. The two lock portions 126 are configured to be capable of cooperating with the lock accommodating portions 207 of the bottle head 200, so as to lock the cap assembly to the bottle. The two lock portions 126 are arranged on an inner surface of the cap side portion 124, and are formed by extending inwardly from the inner surface. The two lock portions 126 are arranged at two ends in the same diameter direction. Each of the two lock portions 126 is arranged at a distance from the lower surface of the cap top 122, such that the elastic member 106 can be accommodated between the cap top 122 and the lock portion 126.

The cap assembly according to the first embodiment of the present application can cooperate with a corresponding bottle, so as to lock the bottle. FIGS. 2A-2B are perspective views of a bottle cooperating with the cap assembly according to the first embodiment of the present application. As shown in FIGS. 2A-2B, the bottle comprises a bottle head 200 and a bottle body 231 (only a part of the bottle body 231 is shown in FIGS. 2A-2B). The bottle head 200 is arranged above the bottle body 231. The bottle head 200 is substantially annular and defines a bottle head passage 203. The bottle body 231 defines a bottle body cavity 233, and a top portion of the bottle body 231 is also annular. The bottle head passage 203 is in communication with the bottle body cavity 233. The bottle head 200 has an inner diameter greater than that of the top portion of the bottle body 231, thereby forming a stepped portion 300 (see FIGS. 3B-3C). The bottle head 200 can be accommodated in the receiving portion 173 of the cap assembly. The bottle head 200 has a top wall 201 configured to cooperate with the elastic arm 156.

As shown in FIGS. 2A-2B, the bottle head 200 is provided with two protrusions 206. The two protrusion 206 are formed by extending outwardly from an outer side of the bottle head 200. In a circumferential direction, there are spacings between the two protrusions 206, thereby forming passages 204. The two passages 204 are arranged at two ends in the same diameter direction to correspond to the two lock portions 126 respectively, such that the lock portions 126 can pass through the passages 204. The protrusion 206 is provided with a lock accommodating portion 207. The lock accommodating portion 207 is configured to cooperate with the lock portion 126, so as to lock the cap assembly to the bottle head 200. Specifically, the lock accommodating portion 207 is formed by recessing upwardly from a bottom of the protrusion 206. In other words, the bottom of the protrusion 206 forms the lock accommodating portion 207. The lock portion 126 can rotate by an angle in the circumferential direction after passing through the passage 204, so as to enter the lock accommodating portion 207. When the lock portion 126 is accommodated in the lock accommodating portion 207, the cap assembly is locked to the bottle head 200. The protrusion 206 is further provided with an exhaust accommodating portion 205 configured to receive the lock portion 126. The exhaust accommodating portion 205 is formed by recessing upwardly from the bottom of the protrusion 206, and is located between the passage 204 and the lock accommodating portion 207 in the circumferential direction. A top portion of the exhaust accommodating portion 205 is higher than a top portion of the lock accommodating portion 207.

As shown in FIGS. 2A-2B, a side wall of the bottle head 200 is further provided with an exhaust pipe 201. The exhaust pipe 201 is formed by extending radially outwardly from the bottle head 200. The exhaust pipe 201 defines an exhaust passage 208. The exhaust passage 208 penetrates the exhaust pipe 201 and the bottle head 200 in a radial direction, such that the exhaust passage 208 is in communication with the bottle head passage 203. Gas in the bottle body cavity 233 can be discharged out of the bottle through the exhaust passage 208.

The cap assembly of the present application can move relative to the bottle, and the bottle assembly has a closed state and an exhaust state. When the lock portion 126 is accommodated in the lock accommodating portion 207, the bottle assembly is in the closed state. When the lock portion 126 is accommodated in the exhaust accommodating portion 205, the bottle assembly is in the exhaust state.

Figure 3A:
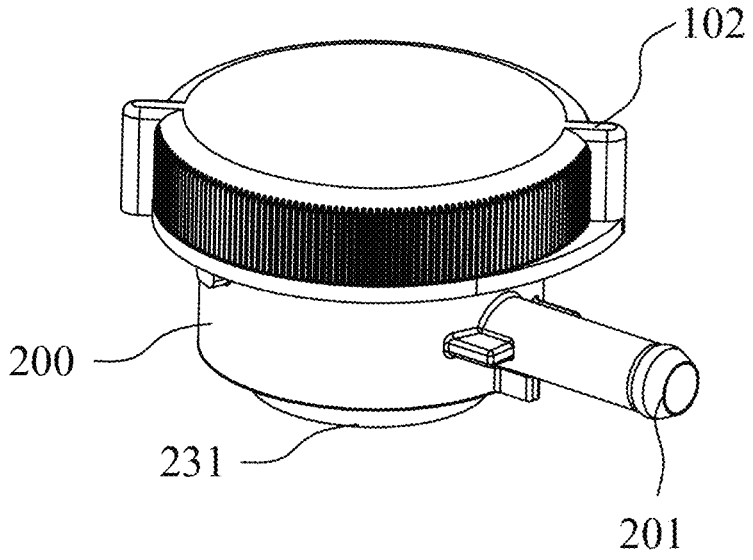
FIG. 3A is a perspective view of a bottle assembly of the present application.
Figure 3B:
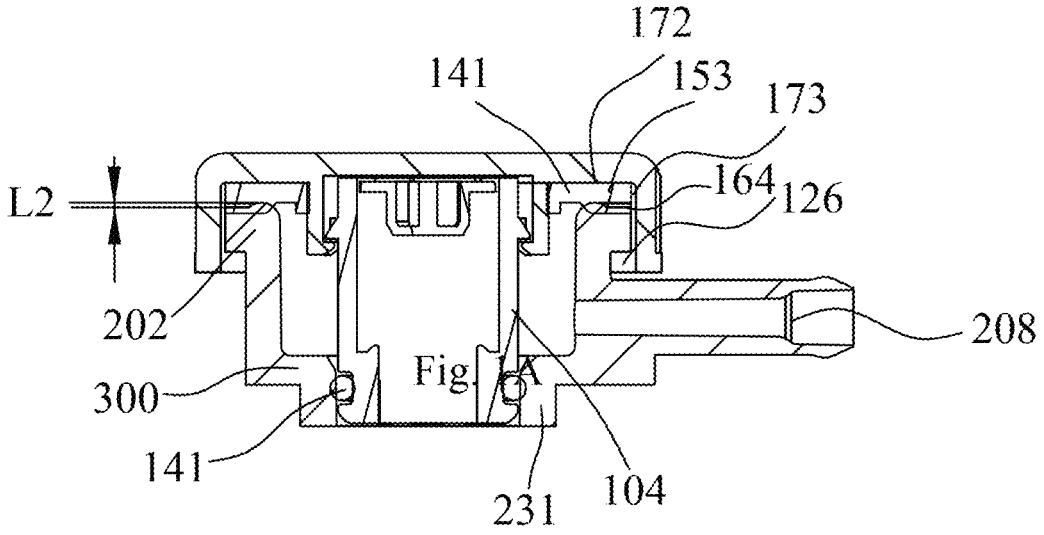
FIG. 3B is a cross-sectional view of the bottle assembly shown in FIG. 3A, the bottle assembly being in a closed state.

FIG. 3A is a perspective view of a bottle assembly of the present application, and FIG. 3B is a cross-sectional view of the bottle assembly shown in FIG. 3A. In FIGS. 3A-3B, the bottle assembly is in the closed state. As shown in FIGS. 3A-3B, when the bottle assembly is in the closed state, the cap assembly is locked to the bottle head 200, the lock portion 126 is located and retained in the lock accommodating portion 207, and the elastic arm 156 of the elastic member 106 is in the compressed state due to the pressing of the cap top 122 and the bottle head 200. Specifically, the free end 164 of the elastic arm 156 abuts and seals against the top wall 201 of the bottle head 200, and the elastic arm 156 abuts and seals against the top wall 172 of the receiving portion 173 via the horizontal portion 153. In this way, when the cap assembly is locked to the bottle head 200, the elastic member 106 seals the cap 102 from the bottle head 200. In addition, when the bottle assembly is in the closed state, a circumferential side portion of the sealing ring 141 abuts against an inner side wall of the bottle body 231, so as to seal the inner cylinder 104 from the bottle body 231. Since the sealing ring 141 seals the inner cylinder 104 from the bottle body 231, the gas in the bottle body cavity 233 remains in the bottle body cavity 233 and cannot be discharged out of the bottle body cavity 233 through the exhaust passage 208.

Figure 3C:
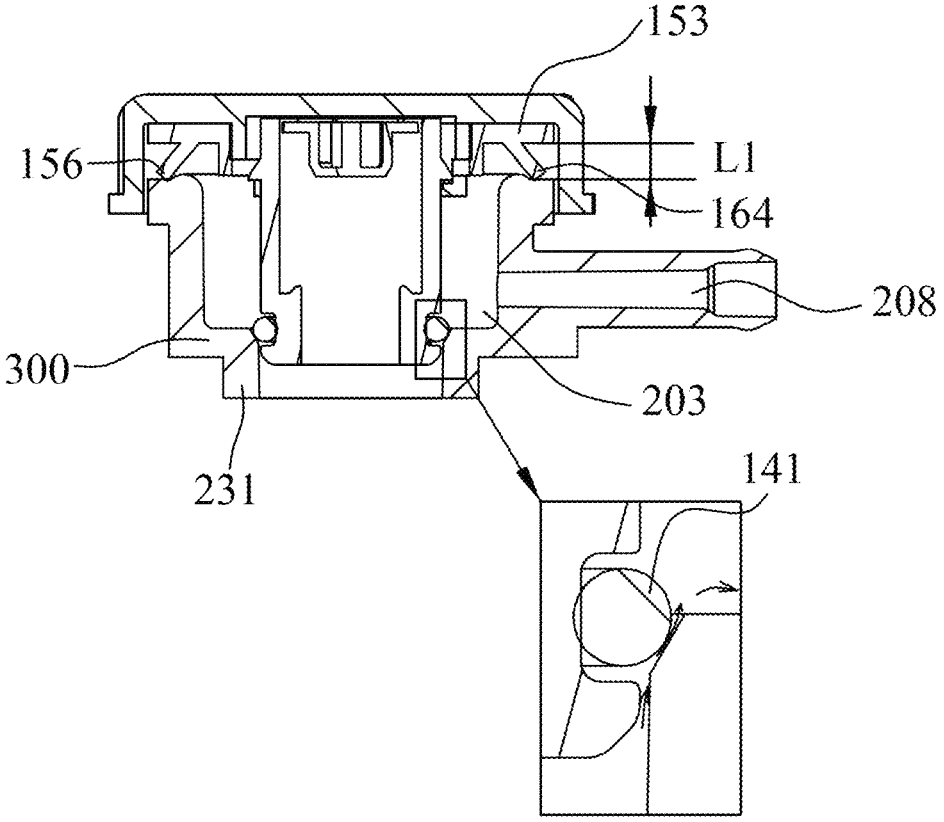
FIG. 3C is a cross-sectional view of the bottle assembly shown in FIG. 3A, the bottle assembly being in an exhaust state.

FIG. 3C is a cross-sectional view of the bottle assembly shown in FIG. 3A, the bottle assembly being in the exhaust state. As shown in FIG. 3C, the cap assembly is not locked to the bottle head 200 when the bottle assembly is in the exhaust state. The lock portion 126 is located in the exhaust accommodating portion 205, and the elastic arm 156 is in the release state or a partially compressed state. The free end 164 of the elastic arm 156 still abuts and seals against the top wall 201 of the bottle head 200, and the elastic arm 156 still abuts and seals against the top wall 172 of the receiving portion 173 via the horizontal portion 153. In this way, when the bottle assembly is in the exhaust state, the elastic member 106 seals the cap 102 from the bottle head 200. In addition, when the bottle assembly is in the exhaust state, the circumferential side portion of the sealing ring 141 is separated from the inner side wall of the bottle body 231. Therefore, the sealing ring 141 no longer seals the inner cylinder 104 from the bottle body 231. Since the sealing ring 141 no longer seals the inner cylinder 104 from the bottle body 231, the bottle body cavity 233 is in communication with the exhaust passage 208 through the bottle head passage 203, and the gas in the bottle body cavity 233 is discharged out of the bottle body cavity 233 through the exhaust passage 208.

The process of locking the bottle head 200 to the cap assembly and sealing the bottle head from the cap assembly is described below with reference to FIGS. 2A and 3B-3C:

When an operator needs to lock the cap assembly to the bottle head 200 and seal the cap assembly from the bottle head, the operator can align the lock portion 126 of the cap assembly with the passage 204 on the bottle, and press the cap assembly down toward the bottle. During the process of the operator pressing the cap assembly, the elastic arm 156 is deformed. Specifically, the free end 164 of the elastic arm 156 abuts against the top wall 201 of the bottle head 200 and moves toward the top wall 172 of the receiving portion 173, such that the elastic arm 156 abuts against the top wall 201 of the bottle head 200 and the top wall 172 of the receiving portion 173. After the lock portion 126 moves downwardly over the protrusion 206, the operator may twist the cap assembly clockwise, such that the lock portion 126 moves clockwise and enters the lock accommodating portion 207. After the lock portion 126 is accommodated in the lock accommodating portion 207, the operator may release the cap assembly. Since the elastic arm 156 is in the compressed state, the elastic arm 156 applies forces in opposite directions to the cap assembly and the bottle head 200, such that the lock portion 126 is retained in the lock accommodating portion 207.

The process of unlocking the cap assembly from the bottle head 200 is described below with reference to FIGS. 2A and 3B-3C:

When the operator needs to unlock the cap assembly from the bottle head 200, the operator may twist the cap assembly counterclockwise, such that the lock portion 126 leaves the lock accommodating portion 207 and enters the exhaust accommodating portion 205. When the lock portion 126 is located in the exhaust accommodating portion 205, the bottle assembly is in the exhaust state. At this time, the elastic member 106 seals the cap 102 from the bottle head 200, and the bottle body cavity 233 is in communication with the exhaust passage 208 through the bottle head passage 203. The gas in the bottle body cavity 233 is discharged out of the bottle body cavity 233 through the exhaust passage 208. When the bottle assembly is in the exhaust state for several seconds, the operator may continue to twist the cap assembly counterclockwise, such that the lock portion 126 leaves the exhaust accommodating portion 205 and enters the passage 204 on the bottle. Finally, the operator lifts up the cap assembly, and the lock portion 126 thus exits the passage 204 to unlock the cap assembly.

It should be noted that although two lock portions 126 and two lock accommodating portions 207 are shown in the present application, which are arranged at two ends in the same diameter direction, any number of lock portions 126 is within the scope of protection of the present application, as long as the number and positions of lock accommodating portions 207 correspond to the number and positions of lock portions 126.

It should also be noted that although the protrusion 206 in the present application is further provided with an exhaust accommodating portion 205, it is possible that no exhaust accommodating portion is provided in other embodiments. Specifically, in the process of unlocking the cap assembly from the bottle head 200, the cap assembly will move away from the bottle head 200 in the axial direction of the bottle head 200, so the exhaust state of the bottle assembly can be realized during the unlocking even if no exhaust accommodating portion is provided.

In conventional cap assemblies, an inner side of the cap is provided with threads so as to cooperate with threads of the bottle to realize locking and sealing. However, the inventors of the present application have found that when the cap and the bottle body are locked to and sealed from each other via the threads, at least three turns of threads need to be screwed in. Therefore, a relatively large height is required to provide the threads. Especially in the field of vehicles, when a component (e.g., a refrigerant pot) accommodated in the vehicle front comprises the bottle assembly, the cap assembly results in a relatively high overall height of the vehicle front.

In the present application, there are no threads provided on the cap assembly, and the cap 102 is kept in place by the cooperation of the lock portion 126 with the lock accommodating portion 207 of the bottle. More specifically, the cap assembly is configured such that when the cap assembly is tightly capped on the bottle, the elastic member 106 is compressed by the force in the vertical direction, so as to apply upward and downward forces to the cap assembly and the bottle respectively, so that the lock portion 126 is retained in the lock accommodating portion 207. As an example, when the elastic arm 156 is in the release state, the overall height of the elastic member 106 is 5 mm. When the elastic arm 156 is in the compressed state, the overall height of the elastic member 106 is 2.15 mm. Since the height of the elastic member in the cap assembly of the present application is relatively small, the height of the cap assembly can be made relatively small, thereby reducing the height of the vehicle front of the vehicle.

In addition, when a low-temperature/high-temperature gas is contained in the bottle, the gas contained in the bottle may expand. The bottle assembly of the present application can realize the exhaust state during the unlocking process, and when the bottle body cavity is in communication with the exhaust passage, the elastic arm still keeps the bottle head sealed. In this way, the expanded low-temperature/high-temperature gas can be discharged out of the bottle body cavity through the exhaust passage in the exhaust state, thereby avoiding overflow through the bottle head passage during the unlocking.

Figure 4A:
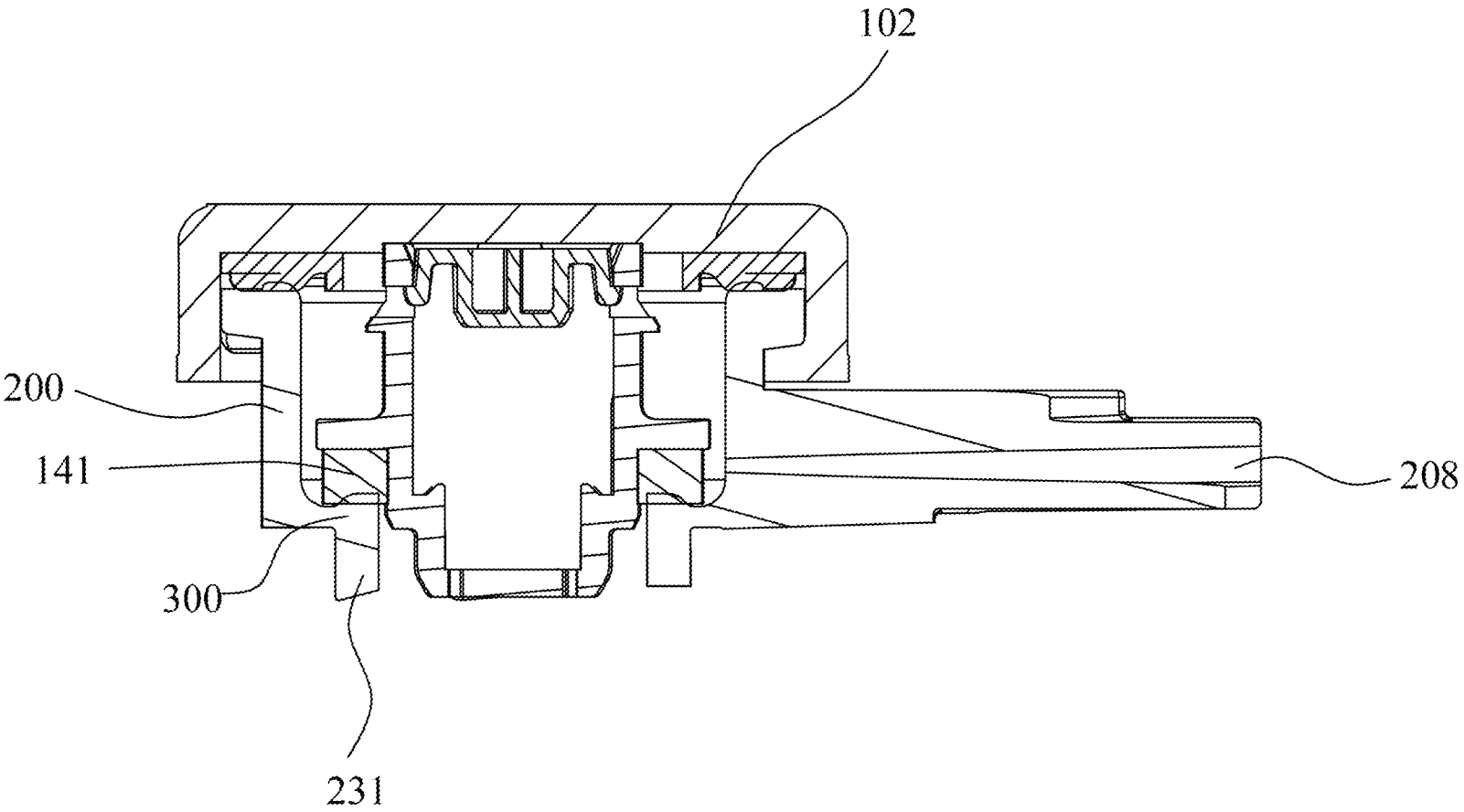
FIG. 4A is a cross-sectional view of a bottle assembly comprising a cap assembly according to a second embodiment of the present application in a closed state.
Figure 4B:
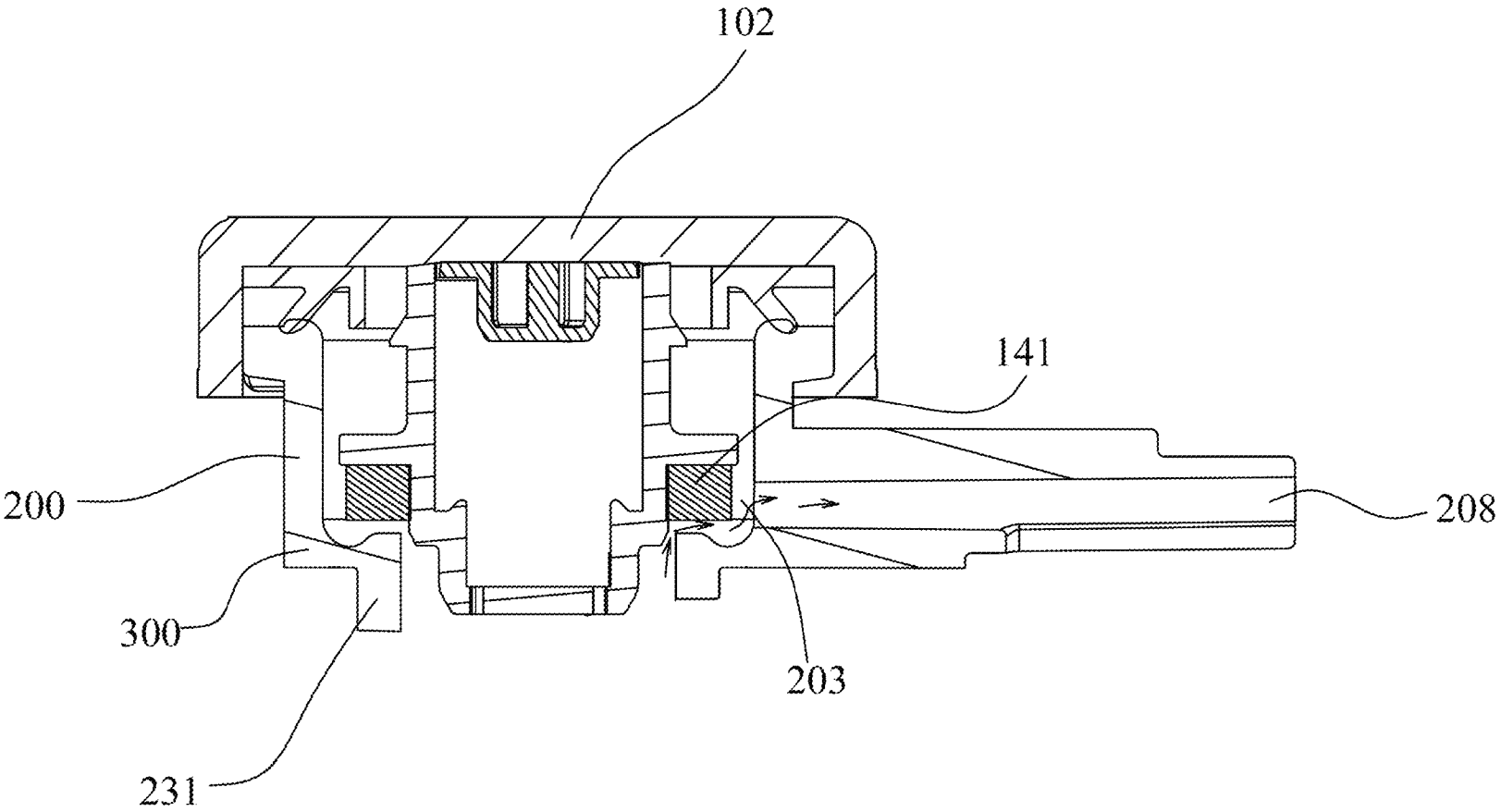
FIG. 4B is a cross-sectional view of the bottle assembly comprising a cap assembly according to the second embodiment of the present application in an exhaust state.

FIGS. 4A-4B are cross-sectional views of the bottle assembly comprising a cap assembly according to the second embodiment of the present application. FIG. 4A is a cross-sectional view of the bottle assembly in the closed state. FIG. 4B is a cross-sectional view of the bottle assembly in the exhaust state. The similarities between the cap assembly shown in FIGS. 4A-4B and the cap assembly shown in FIGS. 1A-1E will not be repeated here. The difference lies in that the circumferential side portion of the sealing ring 141 of the cap assembly shown in FIGS. 1A-1E is used to abut against the bottle body 231, while the bottom portion of the sealing ring 141 of the cap assembly shown in FIGS. 4A-4B is used to abut against the bottle body 231. More specifically, since the inner diameter of the bottle head 200 is greater than that of the top portion of the bottle body 231, the bottom portion of the bottle head 200 and the top portion of the bottle body 231 form a stepped portion 300. The closed state of the bottle assembly can be realized by abutting the bottom portion of the sealing ring 141 against the top portion of the bottle body 231 (i.e., the stepped portion 300), and the exhaust state of the bottle assembly can be realized by separating the bottom portion of the sealing ring 141 from the top portion of the bottle body 231 (i.e., the stepped portion 300). As shown in FIG. 4A, when the bottle assembly is in the closed state, the bottom portion of the sealing ring 141 abuts against an inner wall of the bottle body 231, so as to seal the inner cylinder 104 from the bottle body 231. As shown in FIG. 4B, when the bottle assembly is in the exhaust state, the bottom portion of the sealing ring 141 is separated from the inner wall of the bottle body 231. Therefore, the sealing ring 141 no longer seals the inner cylinder 104 from the bottle body 231. The bottle body cavity 233 is in communication with the exhaust passage 208 through the bottle head passage 203. The gas in the bottle body cavity 233 can be discharged out of the bottle body cavity 233 through the exhaust passage 208.

Although the present application is described in conjunction with the examples of embodiments outlined above, various alternatives, modifications, variations, improvements, and/or substantial equivalents that are known or current or to be anticipated before long may be obvious to those of at least ordinary skill in the art. Furthermore, the technical effects and/or technical problems described in this description are exemplary rather than limiting; therefore, the application in this description may be used to solve other technical problems and have other technical effects and/or may solve other technical problems. Accordingly, the examples of the embodiments of the present application as set forth above are intended to be illustrative rather than limiting. Various changes may be made without departing from the spirit or scope of the present application. Therefore, the present application is intended to embrace all known or earlier disclosed alternatives, modifications, variations, improvements, and/or substantial equivalents.

What is claimed is:

1. A cap assembly configured to lock a bottle, the bottle comprising a bottle head having at least one lock accommodating portion and comprising a bottle body, the cap assembly comprising:

a cap defining an annular receiving portion having an opening facing downward, and the bottle head being capable of entering the receiving portion through the opening;

an elastic member including a horizontal portion and an elastic arm being annular and being arranged in the receiving portion, wherein the elastic arm extends downwardly and obliquely in an outward direction from the horizontal portion; and at least one lock portion being arranged on the cap and being configured to be capable of cooperating with the at least one lock accommodating portion of the bottle head, so as to lock the cap assembly to the bottle head;

wherein the elastic arm is configured such that when the cap assembly is locked to the bottle head, the elastic arm abuts against a top wall of the receiving portion and an upwardly facing surface of a top wall of the bottle head, to apply forces in opposite directions to the cap and the bottle head, so as to retain the at least one lock portion in the at least one lock accommodating portion.

2. The cap assembly according to claim 1, wherein:

the elastic arm is configured such that when the cap assembly is locked to the bottle head, the elastic arm seals the cap from the bottle head.

3. The cap assembly according to claim 1, further comprising:

an elastic ring being arranged in the receiving portion;

wherein the elastic arm has a connecting end and a free end, the connecting end being connected to the elastic ring; and wherein the elastic arm is configured such that during the process of the at least one lock portion entering into the at least one lock accommodating portion, the free end of the elastic arm abuts against the upwardly facing surface of the top wall of the bottle head and moves toward the top wall of the receiving portion.

4. The cap assembly according to claim 3, wherein the cap comprises:

a cap top;

an inner cylinder being formed by extending from the cap top; and a cap side portion, being formed by extending from the cap top, and being arranged around the inner cylinder to form the receiving portion;

wherein the elastic ring is sleeved on an outer side of the inner cylinder, so as to prevent the elastic ring from moving relative to the cap.

5. The cap assembly according to claim 4, further comprising:

a sealing ring being sleeved on the outer side of the inner cylinder;

wherein the sealing ring is configured such that when the cap assembly is locked to the bottle head, the sealing ring abuts against the bottle body, so as to seal the inner cylinder from the bottle body.

6. The cap assembly according to claim 5, wherein:

the sealing ring is configured such that when the cap assembly is locked to the bottle head, a circumferential side portion of the sealing ring abuts against the bottle body, so as to seal the inner cylinder from the bottle body.

7. The cap assembly according to claim 5, wherein:

the sealing ring is configured such that when the cap assembly is locked to the bottle head, a bottom portion of the sealing ring abuts against the bottle body, so as to seal the inner cylinder from the bottle body.

8. The cap assembly according to claim 5, wherein:

the elastic arm and the sealing ring are configured such that during the process of the cap assembly unlocking from the bottle head, the elastic arm abuts against the top wall of the receiving portion and the top wall of the bottle head, so as to seal the cap assembly from the bottle head, and the sealing ring is separated from the bottle body.

9. The cap assembly according to claim 4, wherein:

the at least one lock portion is arranged on an inner surface of the cap side portion, and is formed by extending inwardly from the inner surface.

10. A bottle assembly, comprising:

a cap assembly of claim 1; and a bottle comprising a bottle head, wherein the bottle head is capable of being accommodated in the receiving portion;

wherein the bottle head is provided with at least one lock accommodating portion configured to cooperate with the at least one lock portion, so as to lock the cap assembly to the bottle head.

11. The bottle assembly according to claim 10, wherein:

the bottle head is provided with at least one protrusion being formed by extending outwardly from an outer side wall of the bottle head; and a bottom of the at least one protrusion forms the at least one lock accommodating portion.

12. The bottle assembly according to claim 10, wherein:

the bottle further comprises a bottle body defining a bottle body cavity;

the bottle head defines a bottle head passage being in communication with the bottle body cavity;

the bottle head is provided with an exhaust passage being configured to penetrate the bottle head such that the exhaust passage is in communication with the bottle head passage; and the bottle assembly is configured such that during the process of the cap assembly unlocking from the bottle head, the elastic arm abuts against the top wall of the receiving portion and a top wall of the bottle head, so as to seal the cap assembly from the bottle head, and the bottle body cavity is in communication with the exhaust passage through the bottle head passage.

13. A cap assembly configured to lock a bottle, the bottle comprising a bottle head having at least one lock accommodating portion and comprising a bottle body, the cap assembly comprising:

a cap defining an annular receiving portion having an opening facing downward, and the bottle head being capable of entering the receiving portion through the opening;

an elastic arm being annular and being arranged in the receiving portion; and at least one lock portion being arranged on the cap and being configured to be capable of cooperating with the at least one lock accommodating portion of the bottle head, so as to lock the cap assembly to the bottle head;

wherein the elastic arm is configured such that when the cap assembly is locked to the bottle head, the elastic arm abuts against a top wall of the receiving portion and a top wall of the bottle head, to apply forces in opposite directions to the cap and the bottle head, so as to retain the at least one lock portion in the at least one lock accommodating portion;

wherein the cap assembly further comprises an elastic ring being arranged in the receiving portion;

wherein the cap comprises: a cap top; an inner cylinder being formed by extending from the cap top; and a cap side portion, being formed by extending from the cap top, and being arranged around the inner cylinder to form the receiving portion;

wherein the cap assembly further comprises a sealing ring being sleeved on an outer side of the inner cylinder; and wherein the elastic arm and the sealing ring are configured such that during a process of the cap assembly unlocking from the bottle head, the elastic arm abuts against the top wall of the receiving portion and the top wall of the bottle head, so as to seal the cap assembly from the bottle head, and the sealing ring is separated from the bottle body.

* * * * *